US005997331A

United States Patent [19]

Tu

[11] Patent Number: 5,997,331

[45] Date of Patent: Dec. 7, 1999

[54] GENERALLY U-SHAPED ELECTRICAL CONNECTOR WITH REINFORCED SIDE WALLS

[75] Inventor: Ching-Liang Tu, Taipei Hsien, Taiwan

[73] Assignees: Advanced Connectek Inc., Taipei; Leoco Corporation, Tao-Yuan; EDA Inc., Taipei Hsien, both of Taiwan

[21] Appl. No.: 09/159,234

[22] Filed: Sep. 23, 1998

[30] Foreign Application Priority Data

Mar. 26, 1998 [TW] Taiwan ..... 87204478

[51] Int. Cl.[6] ..... H01R 13/62

[52] U.S. Cl. ..... 439/328

[58] Field of Search ..... 439/327, 325, 439/326, 328, 357

[56] References Cited

U.S. PATENT DOCUMENTS

| | | | |
|---|---|---|---|
| 5,437,560 | 8/1995 | Mizuguchi | 439/326 |
| 5,690,502 | 11/1997 | Mochizuki | 439/328 |
| 5,759,057 | 6/1998 | Cheng et al. | 439/328 |
| 5,791,925 | 8/1998 | Yu | 439/326 |
| 5,803,761 | 9/1998 | Mochizuki | 439/326 |
| 5,860,825 | 1/1999 | Yodogawa | 439/326 |
| 5,888,086 | 3/1999 | Yaegashi et al. | 439/326 |

*Primary Examiner*—Neil Abrams
*Assistant Examiner*—Hae Moon Hyeon
*Attorney, Agent, or Firm*—Finnegan, Henderson, Farabow, Garrett & Dunner, L.L.P.

[57] ABSTRACT

An electrical connector includes a generally U-shaped connector housing, which has two parallel side walls. Each of the side walls is formed with an integral projection, which engages a notch in a circuit board that is inserted into the connector. Two unitary reinforcing members are secured to the side walls, respectively. Each of the unitary reinforcing members has an elongated abutment plate overlying a respective one of the side walls to reinforce the side walls, two contact portions and a stop element, which is located between the contact portions. When inserted into or disengaged from the connector, the circuit board slides over the projections of the side walls, thereby permitting flexing of the side walls and movement of the stop element relative to the contact portions. Upon contact of the stop element with either of the contact portions, the side walls cannot continue to flex. Accordingly, excessive flexure and breakage of the side walls can be prevented.

3 Claims, 6 Drawing Sheets

GENERALLY U-SHAPED ELECTRICAL CONNECTOR WITH REINFORCED SIDE WALLS

BACKGROUND OF THE INVENTION

1. Field of the Invention

This invention relates to an electrical connector, more particularly to a generally U-shaped electrical connector which has reinforced side walls that can be prevented from excessive flexure and breakage.

2. Description of the Related Art

A generally U-shaped electrical connector has a generally U-shaped connector housing into which a circuit board can be inserted. The generally U-shaped connector housing has two parallel side walls, each of which is formed with an integral board-retaining projection. The circuit board has two opposite sides with two opposed notches for engaging the projections to retain the circuit board on the connector. As shown in FIG. 1, each of the side walls 10 has a pin hole 100 into which a pin 11 is inserted. To engage the projections 12 of the side walls 10 within the notches 130 in the circuit board 13, the circuit board 13 slides over inclined surfaces 120 of the projections 12 to push the outer end portions 101 of the side walls 10 outwardly away from each other. To disengage the projections 12 from the notches 130 in the circuit board 13, bent outer end sections 110 of the pins 11 are pulled outwardly, thereby permitting disengagement of the circuit board 13 from the connector. As such, the side walls 10 and the pins 11 may flex excessively and break.

SUMMARY OF THE INVENTION

The object of this invention is to provide a generally U-shaped connector with reinforced side walls which can be prevented from excessive flexure and breakage.

According to this invention, an electrical connector includes a generally U-shaped connector housing, which has two parallel side walls. Each of the side walls is formed with an integral projection, which engages a notch in a circuit board that is inserted into the connector. Two unitary reinforcing members are secured to the side walls, respectively. Each of the unitary reinforcing members has an elongated abutment plate overlying a respective one of the side walls to reinforce the side walls, two contact portions and a stop element, which is located between the contact portions. When inserted into or disengaged from the connector, the circuit board slides over the projections of the side walls, thereby permitting flexing of the side walls and movement of the stop element relative to the contact portions. Upon contact of the stop element with either of the contact portions, the side walls cannot continue to flex. Accordingly, excessive flexure and breakage of the side walls can be prevented.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
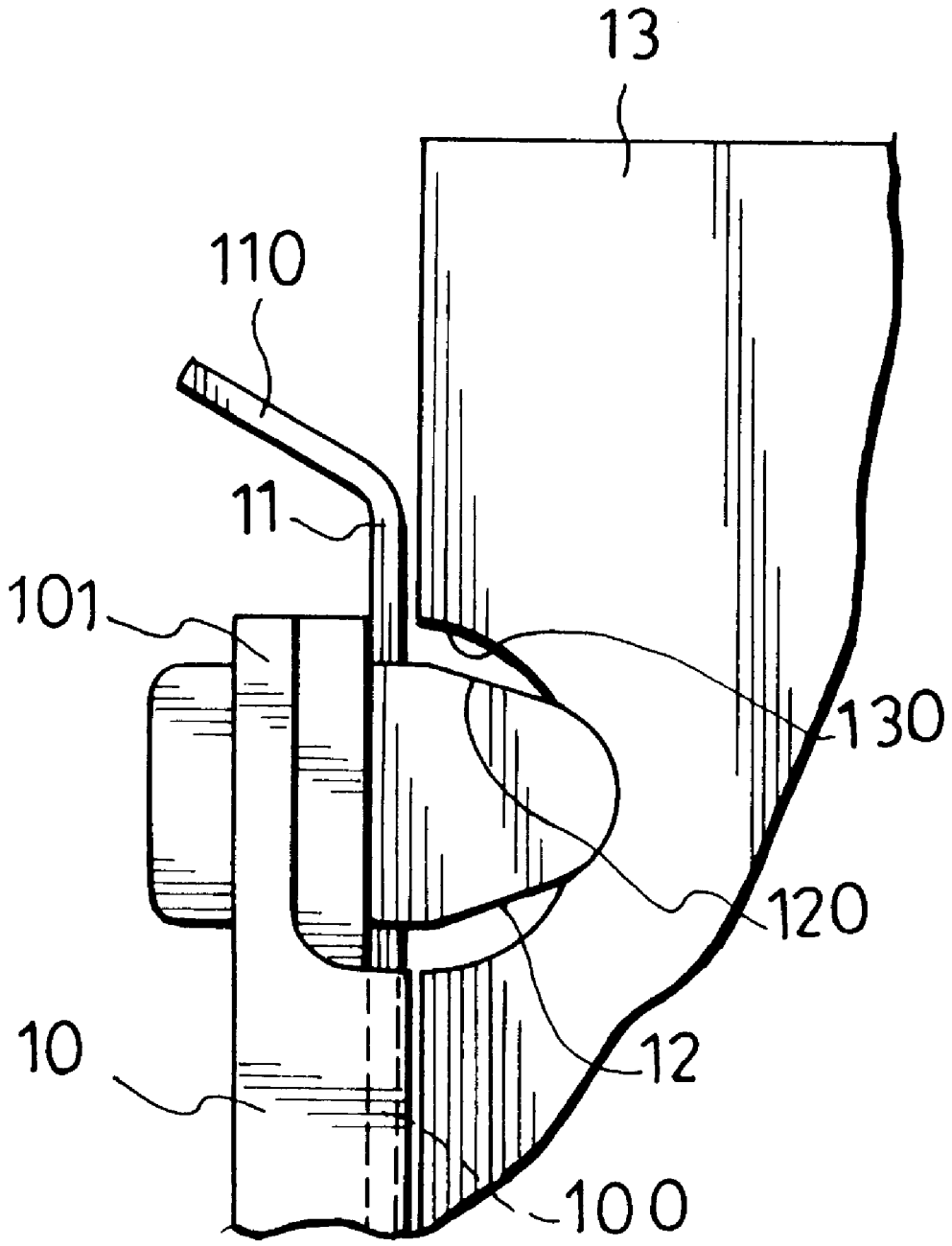
FIG. 1 PRIOR ART
FIG. 1 is a schematic view illustrating how a projection of a side wall of a conventional electrical connector is engaged within a notch in a circuit board.
Figure 2:
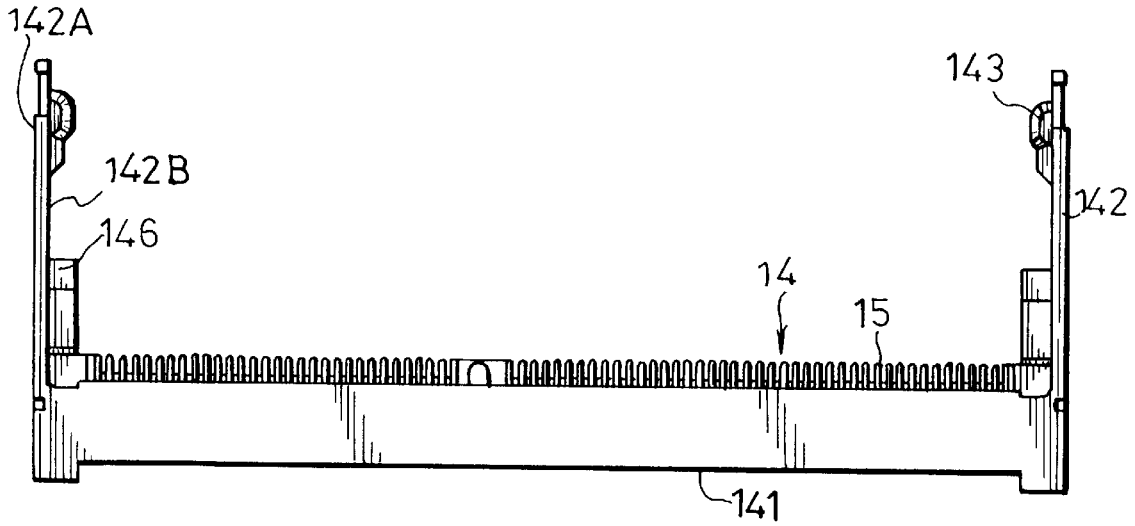
FIG. 2 is an elevational view of the preferred embodiment of an electrical connector according to this invention, in which two reinforcing members are removed.
Figure 3:
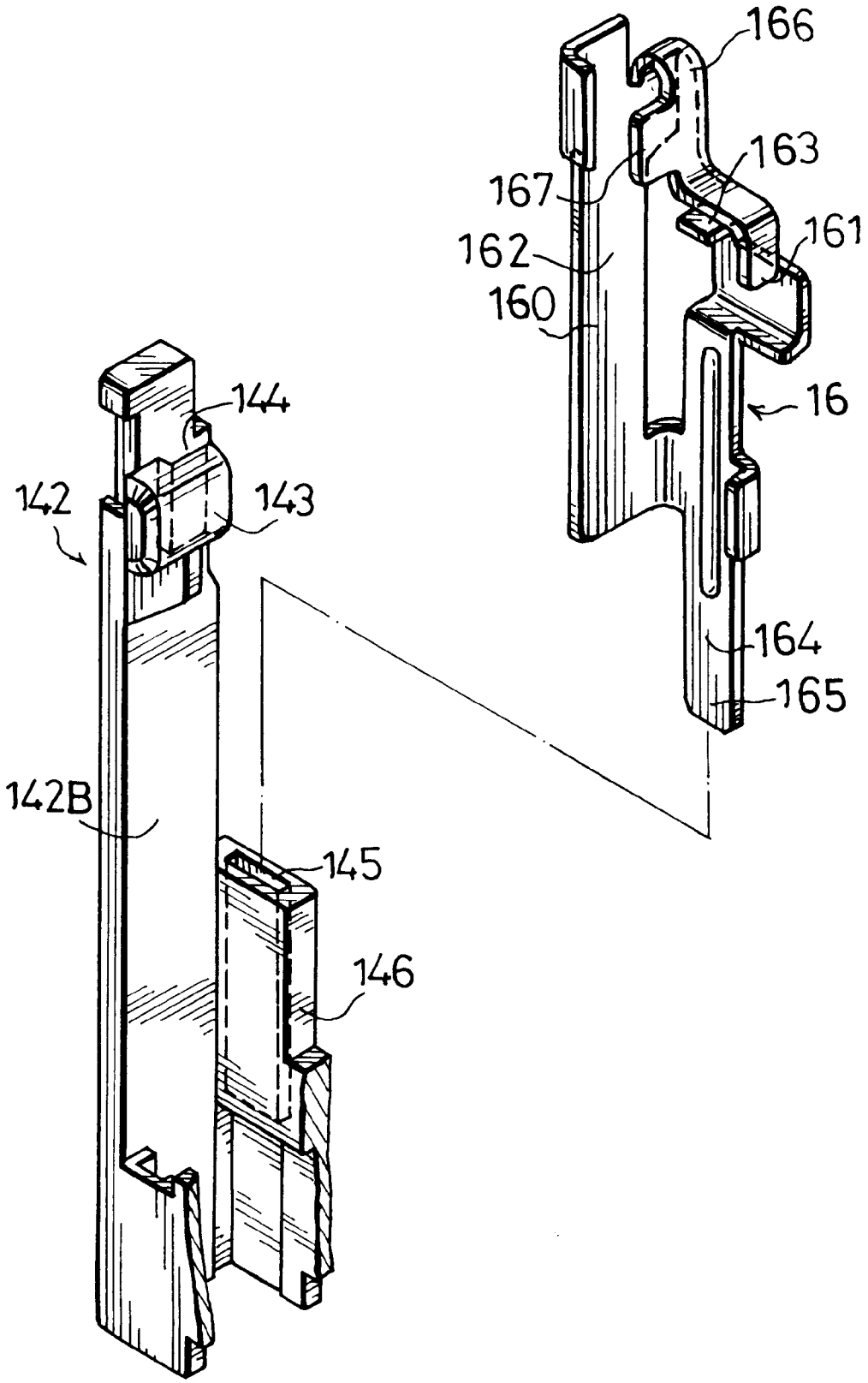
FIG. 3 is an exploded perspective view showing a side wall and one of the reinforcing members of the preferred embodiment.
Figure 3A:
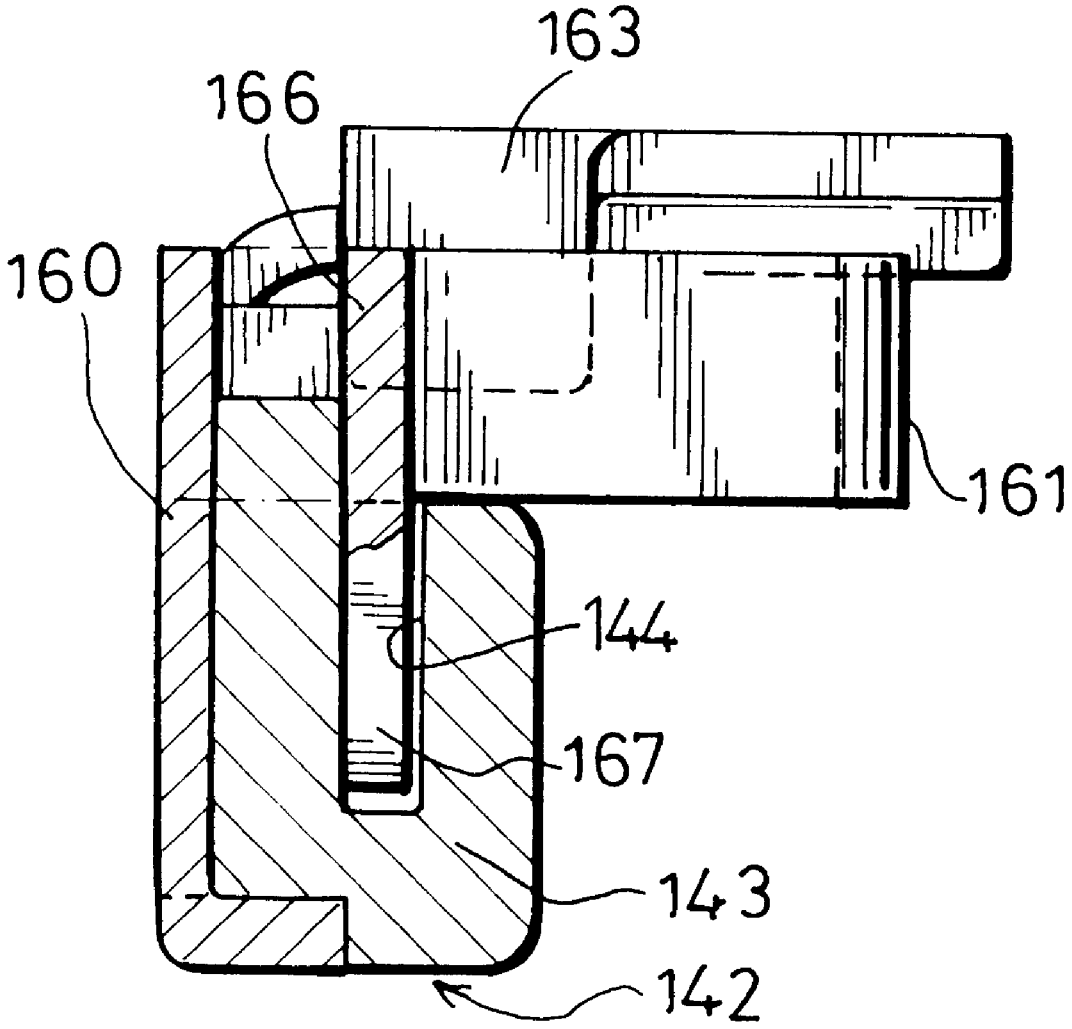
FIG. 3A is a partly sectional end view showing the assembly of the side wall and the reinforcing member of FIG. 3.
Figure 4:
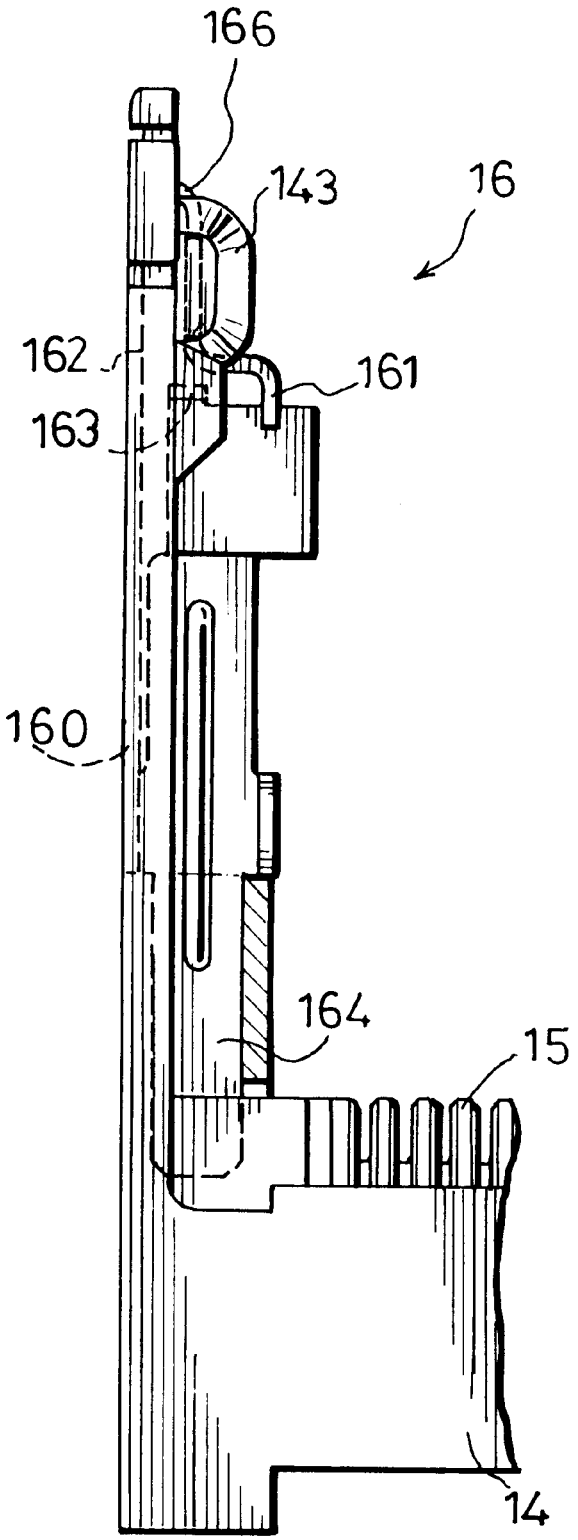
FIG. 4 illustrates the position of a stop element relative to two contact portions of the reinforcing member in the preferred embodiment.
Figure 5:
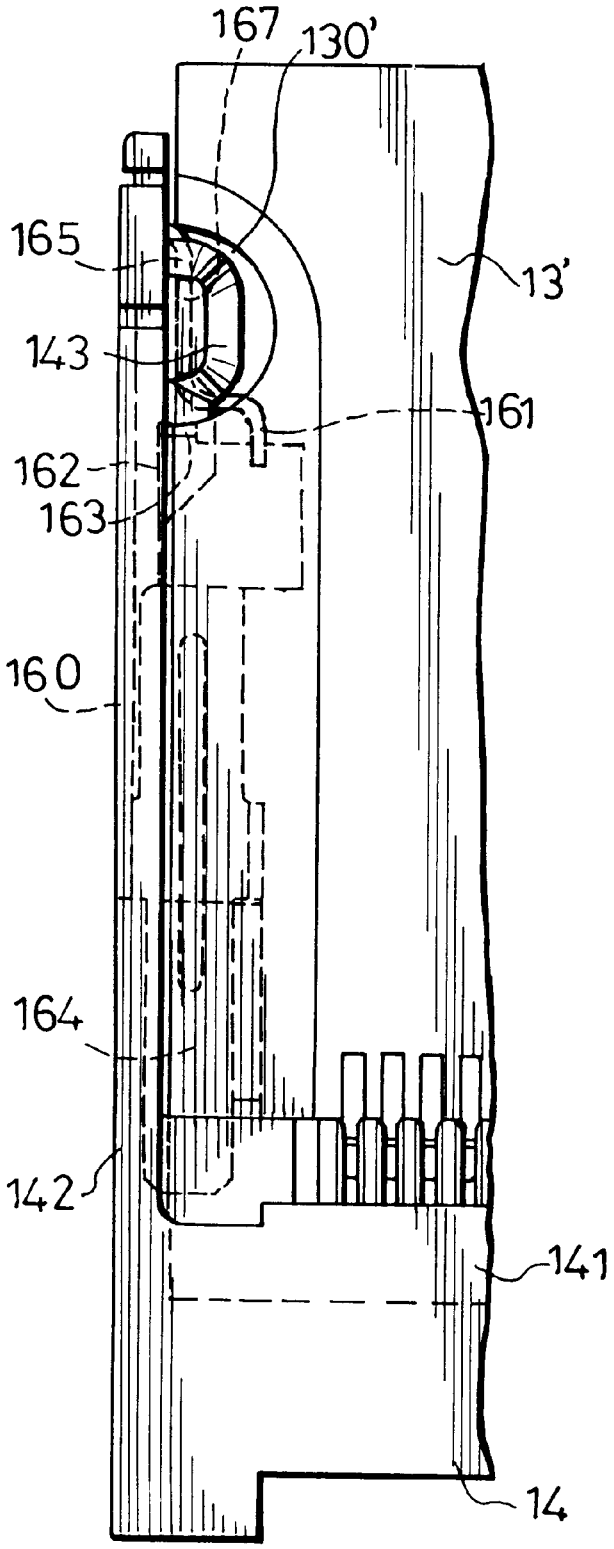
FIG. 5 illustrates how a circuit board is inserted into the preferred embodiment.

Referring to FIGS. 2, 3, 3A, 4 and 5, the preferred embodiment of an electrical connector of this invention is shown to include a generally U-shaped connector housing 14, a terminal unit 15 and two unitary reinforcing members 16. The housing 14 is adapted to receive a circuit board 13' (see FIG. 5) therein.

The generally U-shaped connector housing 14 is made of plastic, and has an elongated straight housing body 141 on which the terminal unit 15 is mounted, and two elongated parallel side walls 142, which are connected respectively and fixedly to two ends of the housing body 141. Each of the side walls 142 has an outer side surface (142A) (see FIG. 2) and an inner side surface (142B) (see FIG. 2), which are perpendicular to the circuit board 13' (see FIG. 5). Each of the inner side surfaces (142B) (see FIG. 2) has an inner end portion connected to the housing body 141, and an outer end portion, which is formed with an integral board-retaining projection 143. The projections 143 are adapted to engage respectively two notches 130' (see FIG. 5) in opposite sides of the circuit board 13' for retaining the circuit board 13' on the connector. Each of the side walls 142 further has an outer groove 144 formed in the respective projection 143, and an inner groove 145 formed in a projecting block 146, which is formed integrally with the side wall 142.

Each of the unitary reinforcing members 16 is made of a metal, and has an elongated abutment plate 160 which is perpendicular to the circuit board 13', an inner contact portion 161, an outer contact portion 162, and a stop element 163, which is located between the inner and outer contact portions 161, 162. In each of the reinforcing members 16, the abutment plate 160 overlies the outer side surface 142A (see FIG. 2) of the side wall 142 to reinforce the side wall 142, and has an inner end portion located near the housing body 141, and an outer end portion away from the housing body 141. An inner extension portion 164 extends from the inner end portion of each of the abutment plates 160, and has a tongue portion 165, which is fitted within the inner groove 145 in the respective projecting block 146. An outer extension portion 166 extends from the outer end portion of each of the abutment plates 160, and has a lug portion 167, which is fitted within the outer groove 144 in the respective projection 143. Accordingly, the reinforcing members 16 are secured respectively to the side walls 142.

In this embodiment, each of the stop elements 163 is shaped as a flat plate, which is formed on the respective inner extension portion 164 and which is perpendicular to the respective abutment plate 160. Each of the inner contact portions 161 is shaped as a flat plate, which is formed in the respective outer extension portion 166 and which is parallel to the respective abutment plate 160. Each of the outer contact portion 162 is a portion of the respective abutment plate 160, which is aligned with the corresponding stop element 163. In each of the reinforcing members 16, the stop element 163 is spaced apart from the contact portions 161, 162 at predetermined distances. As such, when the circuit board 13' is inserted into or removed from the connector to flex the side walls 142, the contact portions 161, 162 move relative to the stop elements 163. The side walls 142 can flex inwardly toward each other unit until the outer contact portion 162 contacts the stop elements 163, and can flex outwardly away from each other until the inner contact portion 161 contacts the stop elements 163.

Alternatively, the inner contact portions 161 may be formed on the inner extension portions 164, while the stop elements 163 may be formed on the outer extension portions 165, as long as the stop elements 163, when flexed, can contact either the inner or outer contact portions 161.

With this invention thus explained, it is apparent that numerous modifications and variations can be made without departing from the scope and spirit of this invention. It is therefore intended that this invention be limited only as indicated in the appended claims.

I claim:

1. An electrical connector for receiving a circuit board, the circuit board having two opposite sides formed with opposed notches, said connector including a generally U-shaped connector housing and a terminal unit, said housing being made of plastic and having an elongated straight housing body on which said terminal unit is mounted, and two elongated side walls connected respectively and fixedly to two ends of said housing body, each of said side walls having an outer side surface and an inner side surface which are adapted to be disposed perpendicular to the circuit board, each of said inner side surfaces having an inner end portion connected to said housing body, and an outer end portion, which is formed with a board-retaining projection, said board-retaining projections being adapted to engage respectively the notches of the circuit board to retain the circuit board on said connector, said connector further including two unitary reinforcing members, which are secured respectively and fixedly to said side walls, each of said reinforcing members having an elongated abutment plate overlying a respective one of said side walls, a pair of inner and outer contact portions, and a stop element, which is connected to an end portion of said abutment plate and which is located between said inner and outer contact portions in such a manner that said inner and outer contact portions are spaced apart from said stop element at predetermined distances, said stop element moving relative to said inner and outer contact portions when said side walls flex upon sliding movement of the circuit board over said projections, said side walls being capable of flexing inwardly toward each other until said stop elements contact said outer contact portions, said side walls being capable of flexing outwardly away from each other until said stop elements contact said inner contact portions, whereby, when the circuit board is inserted into and removed from said connector, breakage of said side walls can be prevented.

2. An electrical connector as claimed in claim 1, wherein said reinforcing members are made of a metal.

3. An electrical connector as claimed in claim 1, wherein said abutment plate of each of said reinforcing members has an inner end portion located near said housing body, and an outer end portion away from said housing body, each of said reinforcing members having an inner extension portion which extends from said inner end portion of a respective one of said abutment plates, and an outer extension portion which extends from said outer end portion of a respective one of said abutment plates, each of said stop elements being shaped as a flat plate which is formed on a respective one of said inner extension portions and which is perpendicular to said abutment plates, each of said outer contact portions being a portion of a respective one of said abutment plates, each of said inner contact portions being shaped as a flat plate which is formed on a respective one of said outer extension portions and which is parallel to said abutment plates.

* * * * *